US009649238B2

(12) United States Patent
Dubois et al.

(10) Patent No.: US 9,649,238 B2
(45) Date of Patent: May 16, 2017

(54) PORTABLE CHAMBER FOR HYPERBARIC AND/OR HYPOXIC TREATMENT

(75) Inventors: André Dubois, Brownsburg-Chatham (CA); Richard Langlois, Laval (CA); Claude Gaumond, Lachine (CA)

(73) Assignee: GROUPE MEDICAL GAUMOND INC., Terrebonne (CA)

( * ) Notice: Subject to any disclaimer, the term of this patent is extended or adjusted under 35 U.S.C. 154(b) by 85 days.

(21) Appl. No.: 13/881,814

(22) PCT Filed: Oct. 27, 2010

(86) PCT No.: PCT/CA2010/001697

§ 371 (c)(1),
(2), (4) Date: Apr. 26, 2013

(87) PCT Pub. No.: WO2012/055003

PCT Pub. Date: May 3, 2012

(65) Prior Publication Data

US 2013/0206146 A1 Aug. 15, 2013

(51) Int. Cl.
*A61G 10/02* (2006.01)
*B63C 11/32* (2006.01)

(52) U.S. Cl.
CPC ..... *A61G 10/026* (2013.01); *B63C 11/325* (2013.01); *A61G 10/02* (2013.01); *A61G 10/023* (2013.01)

(58) Field of Classification Search
CPC .. A61G 10/005; A61G 10/023; A61G 10/026; A61M 21/0094

(Continued)

(56) References Cited

U.S. PATENT DOCUMENTS 4,811,729 A * 3/1989 Sands et al. ..... 128/202.12
5,255,673 A * 10/1993 Cardwell ..... A61G 10/026 128/202.12

(Continued)

FOREIGN PATENT DOCUMENTS

WO WO 2008014617 A1 * 2/2008 ..... A61G 10/02

OTHER PUBLICATIONS

European Search Report for EP 2632409.

*Primary Examiner* — Lynne Anderson
*Assistant Examiner* — Elliot S Ruddie
(74) *Attorney, Agent, or Firm* — Brouillette Legal Inc.; Robert Brouillette

(57) ABSTRACT

A portable chamber for hyperbaric and/or hypoxic treatment comprises an open-ended and typically frustro-conical tubular body sized to accommodate at least one occupant, and two end members configured to be respectively received at opposite extremities of the body for closing the body in a seal tight arrangement. The body of the chamber is made of a flexible yet reinforced elastomeric material such as to be collapsible during transport. One of the end members is provided with a door to provide access to the interior of the chamber. The extremities of the body are substantially spherical such as to receive the correspondingly substantially periphery of the end members. When the chamber is supplied with gases during hyperbaric or hypoxic treatment, the spherical peripheries of the end members are urged against the spherical extremities of the body, thereby providing a seal tight chamber. A treatment system comprising the chamber is also disclosed.

24 Claims, 10 Drawing Sheets

(58) Field of Classification Search
USPC ..... 128/202.1, 205.26; 600/21
See application file for complete search history.

(56) References Cited

U.S. PATENT DOCUMENTS 5,678,722 A * 10/1997 Reneau ..... 220/323
6,321,746 B1 * 11/2001 Schneider ..... A61G 10/026
128/202.12

* cited by examiner

PORTABLE CHAMBER FOR HYPERBARIC AND/OR HYPOXIC TREATMENT

CROSS-REFERENCE TO RELATED APPLICATIONS

There are no cross-related applications.

FIELD OF THE INVENTION

The present application generally relates to hyperbaric and/or hypoxic chambers and chamber systems and, more particularly, to portable hyperbaric and/or hypoxic chambers and chamber systems.

BACKGROUND OF THE INVENTION

Hyperbaric chambers and chamber systems are well known and used in the medical and sports industries. In essence, occupants of hyperbaric chambers undergo hyperbaric treatments in which they are subjected to relatively high pressures. Hyperbaric treatments are known, amongst other things, to enhance muscular recuperation and to increase oxygen inhalation.

In hypoxic chambers and chamber systems, the occupant is subjected to lower oxygen contents such as to simulate high altitudes. For their part, hypoxic treatments are known, amongst other things, to stimulate the production of red blood cells.

Conventional hyperbaric chambers are typically made of rigid materials capable of withstanding pressure differentials. Accordingly, hyperbaric treatments are not commonly accessible and are often only available to elite-level athletes and selected patients.

Accordingly, portable hyperbaric chambers have been developed to become more accessible. Examples of portable hyperbaric chambers are described in U.S. Pat. Nos. 3,877,427; 5,109,837; 5,255,673; 5,738,093; 6,321,746 and in International Patent Application Nos. PCT/GB2004/001139 (published under no. WO 2004/082552), and PCT/CA2007/001365 (published under no. WO 2008/014617).

However, prior art portable chambers have some shortcomings. For instance, some of the prior art chambers are not sturdy and therefore not durable. Other prior art chambers have complex construction, making them difficult to disassemble for transport. Still some other prior art chambers are limited to hyperbaric treatments.

Hence, despite ongoing developments in the field of hyperbaric and hypoxic chambers, there is still a need for an improved portable chamber which will mitigate the shortcomings of prior art portable chambers used for hyperbaric and/or hypoxic treatments.

SUMMARY OF THE INVENTION

An improved portable chamber for hyperbaric and/or hypoxic treatment in accordance with the principles of the present invention generally mitigates the shortcomings of prior art chambers by being easily disassembled and collapsed for transport and yet sturdy enough to sustain significant pressure (e.g. typically 30 psig and up to 180 psig).

In accordance with one aspect of the invention, there is provided a chamber suitable for use with a portable hyperbaric and/or hypoxic chamber system, the chamber being connectable to at least one source of gases for receiving a supply of gases during a treatment. The chamber comprises:

a) An open-ended tubular body sized to accommodate at least one occupant, the tubular body being made of a flexible and reinforced elastomeric material; the tubular body comprising:

i) a first opening at a first extremity of the tubular body;

ii) a first substantially spherical extremity section adjacent with the first opening and having a first radius of curvature;

iii) a second opening at a second extremity of the tubular body;

iv) a second substantially spherical extremity section adjacent with the second opening and having a second radius of curvature; and v) a longitudinal axis.

b) A first end member adapted to be inserted into the open-ended tubular body and configured to be mounted substantially inside the tubular body at the first substantially spherical extremity section of the tubular body to close off the first opening of the first extremity section of the tubular body. The first end member comprises a first substantially spherical periphery having an exterior surface and a third radius of curvature, the third radius of curvature of the first end member being equal to the first radius of curvature of the first substantially spherical extremity section when the chamber is under pressure. The first end member also comprises a door for providing access to an interior of the tubular body.

c) A second end member adapted to be inserted into the open-ended tubular body and configured to be mounted substantially inside the tubular body at the second substantially spherical extremity section of the tubular body to close off the second opening of the second extremity section of the tubular body. The second end member comprises a second substantially spherical periphery having an exterior surface and a fourth radius of curvature, the fourth radius of curvature of the second member being equal to the second radius of curvature of the second substantially spherical extremity section when the chamber is under pressure.

In use, when the chamber is supplied with gases during hyperbaric and/or hypoxic treatment, the first and second end members are moved under pressure along the longitudinal axis in opposite directions such as the exterior surfaces of the spherical peripheries of the first and second end members are respectively urged against the spherical extremity sections of the first and second extremities of the flexible tubular body, thereby sealing the chamber.

In accordance with another aspect of the invention, there is provided a portable chamber suitable for hyperbaric and/or hypoxic treatment, the chamber being connectable to at least one source of gases for receiving a supply of gases during the treatment. The chamber comprises:

a) An open-ended frustro-conical tubular body sized to accommodate at least one occupant, the tubular body being made of a flexible and reinforced elastomeric material, the tubular body comprising:

i) a first opening at a first extremity of the tubular body;

ii) a first substantially spherical extremity section adjacent with the first opening and having a first radius of curvature;

iii) a second opening at a second extremity of the tubular body;

iv) a second substantially spherical extremity section adjacent with the second opening and having a second radius of curvature, the first radius of curvature being larger than the second radius of curvature; and v) a longitudinal axis.

b) A first end member adapted to be inserted into the open-ended tubular body and configured to be mounted substantially inside the tubular body at the first extremity section to close off the first opening of the first extremity section. The first end member comprises a first substantially spherical periphery having an exterior surface and a third radius of curvature, the third radius of curvature of the first end member being equal to the first radius of curvature of the first substantially spherical extremity section when the chamber is under pressure. The first end member also comprises a door for providing access to an interior of the tubular body.

c) A second end member adapted to be inserted into the open-ended tubular body and configured to be mounted substantially inside the tubular body at the second extremity section to close off the second opening of the second extremity section. The second end member comprises a second substantially spherical periphery having an exterior surface and a fourth radius of curvature, the fourth radius of curvature of the second end member being equal to the second radius of curvature of the second substantially spherical extremity section when the chamber is under pressure.

In use, when the chamber is supplied with gases during hyperbaric and/or hypoxic treatment, the first end member is moved under pressure along the longitudinal axis towards the first extremity such as the first end member is urged against the first extremity section of the flexible tubular body, the exterior surface of the first spherical periphery then engaging an inner surface of the first extremity. Also, the second end member is moved under pressure along the longitudinal axis towards the second extremity such as the second end member is urged against the second extremity section of the flexible tubular body, the exterior surface of the second spherical periphery then engaging an inner surface of the second extremity, thereby sealing the chamber.

In accordance with another aspect of the invention, there is provided a hyperbaric and/or hypoxic chamber system comprising:

a) At least one source of gases;

b) A chamber connectable to the at least one source of gases for receiving a supply of gases, the chamber comprising:

i) an open-ended tubular body sized to accommodate at least one user, the tubular body being made of a flexible and reinforced elastomeric material. The tubular body comprises a longitudinal axis, a first opening at a first extremity of the tubular body, a first substantially spherical extremity section adjacent with the first opening and having a first radius of curvature, and a second opening at a second extremity of the tubular body; a second substantially spherical extremity section adjacent with the second opening and having a second radius of curvature;

ii) A first end member adapted to be inserted into the open-ended tubular body and configured to be mounted substantially inside the tubular body at the first extremity section to close off the first opening of the first extremity section. The first end member comprises a first substantially spherical periphery having an exterior surface and a third radius of curvature, the third radius of curvature of the first end member being equal to the first radius of curvature of the first substantially spherical extremity section when the chamber is under pressure. The first end member also comprises a door for providing access to an interior of the chamber;

iii) A second end member adapted to be inserted into the open-ended tubular body and configured to be mounted substantially inside the tubular body at the second extremity section to close off the second opening of the second extremity section. The second end member comprises a second substantially spherical periphery having an exterior surface and a fourth radius of curvature, the fourth radius of curvature of the second end member being equal to the second radius of curvature of the second substantially spherical extremity section when the chamber is under pressure.

In use, when the chamber received the supply of gases during hyperbaric and/or hypoxic treatment, the first end member is moved under pressure along the longitudinal axis towards the first extremity such as the first end member is urged against the first extremity section of the flexible tubular body, the exterior surface of the first spherical periphery then engaging an inner surface of the first extremity section. Also, the second end member is moved under pressure along the longitudinal axis towards the second extremity such as the second end member is urged against the second extremity section of the flexible tubular body, the exterior surface of the second spherical periphery then engaging an inner surface of the second extremity section, thereby sealing the chamber during the treatment.

Hence, a portable chamber in accordance with the principles of the present invention generally comprises an open-ended and typically frustro-conical tubular body suitably sized to accommodate at least one occupant, and two end members respectively configured to be received at opposite extremities of the body for closing the body in a seal tight arrangement.

The body is made of a flexible yet reinforced elastomeric material such as to be collapsible during transport yet resistant enough to sustain hyperbaric pressure (e.g. typically 30 psig and up to 180 psig) during hyperbaric treatment.

The body is typically made of a latex-neoprene elastomeric composition and is typically reinforced with aramid fibers or filaments. The aramid filaments are typically, though not necessarily, wound about the body at an angle of ±54.7° with respect to the central axis of the body.

The end members of the chamber are made of rigid reinforced material. The end members are typically made of a fiberglass/epoxy composition having a polymeric foam core.

One of the end members, typically the larger one, is provided with a displaceable door to provide access to the interior of the chamber. The door is secured to the larger end member via a locking ring assembly.

The door and the smaller end member are typically each provided with a window.

The extremities of the body are substantially spherical (i.e. inwardly rounded) such as to receive the correspondingly substantially spherical (or rounded) periphery of the end members. With this particular configuration, when the chamber is supplied with gases during hyperbaric or hypoxic treatment, the exterior surfaces of the spherical peripheries of the end members are urged against the interior surfaces of the spherical extremities of the body, thereby sealing the chamber.

In that sense, the seal between the end members and the extremities of the tubular body is provided by the engagement of the surfaces of the spherical peripheries of the end members against the interior surfaces of the spherical extremities of the body. No other sealing assemblies are typically required.

This particular configuration provides a much simple chamber without complex sealing arrangements such as, but not limited to, sealing rings, bolted flanges, etc., allowing the chamber to be easily dismantled or collapsed for transport and providing a better (e.g. continuous, uniform) seal at the interface between the end members and the extremities of the body.

One or both of the end members are typically provided with one or more inlets connectable to one or more sources of gases (e.g. a pressure generator, a hypoxic generator, etc.) such as to allow the chamber to receive a supply of gases to during hyperbaric or hypoxic treatment. One or both of the end members are also provided with one or more outlets to allow the gases to exit the chamber.

The chamber can advantageously be used with a supporting structure for receiving and supporting the chamber during use, and with a controlling system for controlling the conditions within the chamber during hyperbaric or hypoxic treatment. A non-limitative example of a possible supporting structure which incorporates the controlling system and the source(s) of gases (e.g. a pressure generator, a hypoxic generator, etc.) is shown in International patent application no. PCT/CA2007/001365 (published under no. WO 2008/014617).

Other and further aspects and advantages of the present invention will be obvious upon an understanding of the illustrative embodiments about to be described or will be indicated in the appended claims, and various advantages not referred to herein will occur to one skilled in the art upon employment of the invention in practice. The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which:

FIG. 7 is a cross cross-sectional side view of the first end member of the chamber of FIG. 1.

DETAILED DESCRIPTION OF THE PREFERRED EMBODIMENT

A novel portable chamber for hyperbaric and/or hypoxic treatment will be described hereinafter. Although the invention is described in terms of specific illustrative embodiments, it is to be understood that the embodiments described herein are by way of example only and that the scope of the invention is not intended to be limited thereby.

Figure 1:
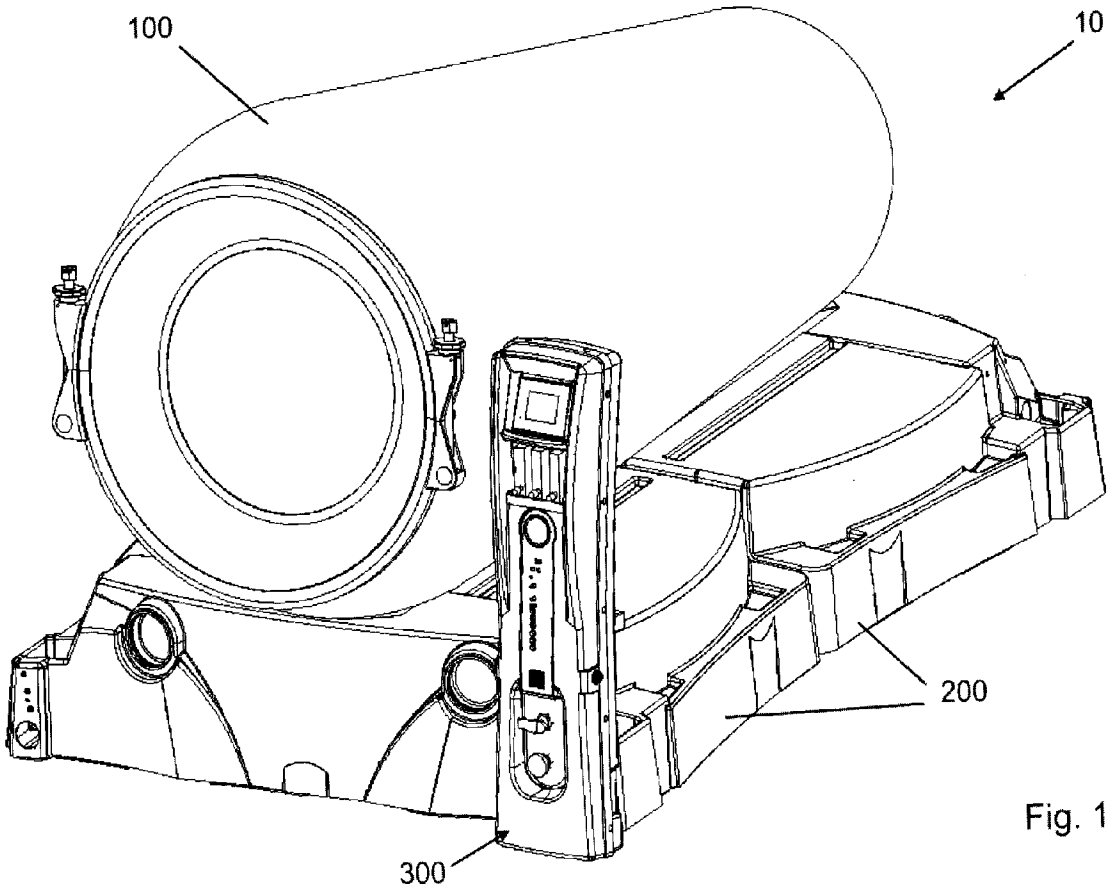
FIG. 1 is a perspective view of an embodiment of a chamber in accordance with the principles of the present invention as installed on a hyperbaric and/or hypoxic chamber system.

Referring now to the drawings, and more particularly to FIG. 1, a portable hyperbaric and/or hypoxic chamber system 10, comprising a chamber 100 in accordance with the principles of the present invention, is illustrated.

The chamber system 10 comprises a chamber 100 suitable for hyperbaric and hypoxic treatments, as well as various sources (not shown) of gases (e.g. air, oxygen, etc.) to modify the conditions of air inside the chamber 100 with respect to the ambient conditions outside the chamber 100. These various sources, which typically include a pressure generator, a hypoxic generator and an oxygen source, are preferably, though not necessarily, all incorporated into the supporting structure 200 which supports the chamber 100 during treatment, and are in fluid communication with the interior of the chamber 100 via appropriate pipes, valves, inlets and outlets (not shown). These sources are also typically controlled by a control system 300, which can include a console. The control system 300 is operatively connected to the various sources such as to control the conditions within the chamber 100 during hyperbaric or hypoxic treatment. The control system 300 could also be operatively connected to diverse sensors located inside the chamber 100 and/or on the user undergoing a treatment to monitor the conditions inside the chamber 100 (e.g. ambient pressure, ambient oxygen level, etc.) and/or the conditions of the user (e.g. heartbeat, oxygen level in the blood, etc.). Such supporting structure 200 and control system 300 are known in the art (see for instance WO 2008/014617) and need not be described any further.

Still referring to FIG. 1, the chamber 100 is typically sized to accommodate at least one user or occupant that will undergo a hyperbaric or a hypoxic treatment.

Figure 2:
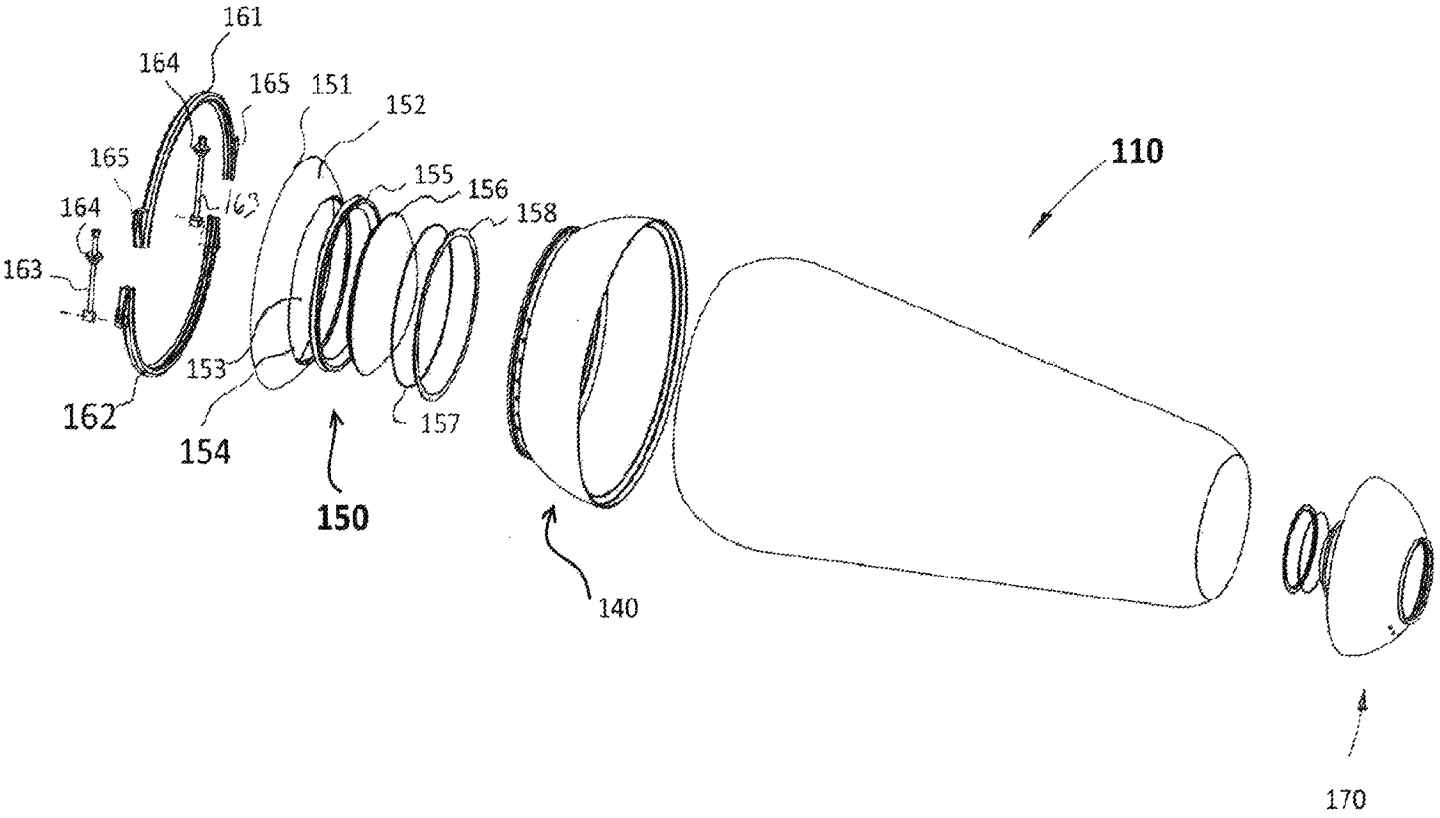
FIG. 2 is an exploded perspective view of the chamber of FIG. 1.
Figure 3:
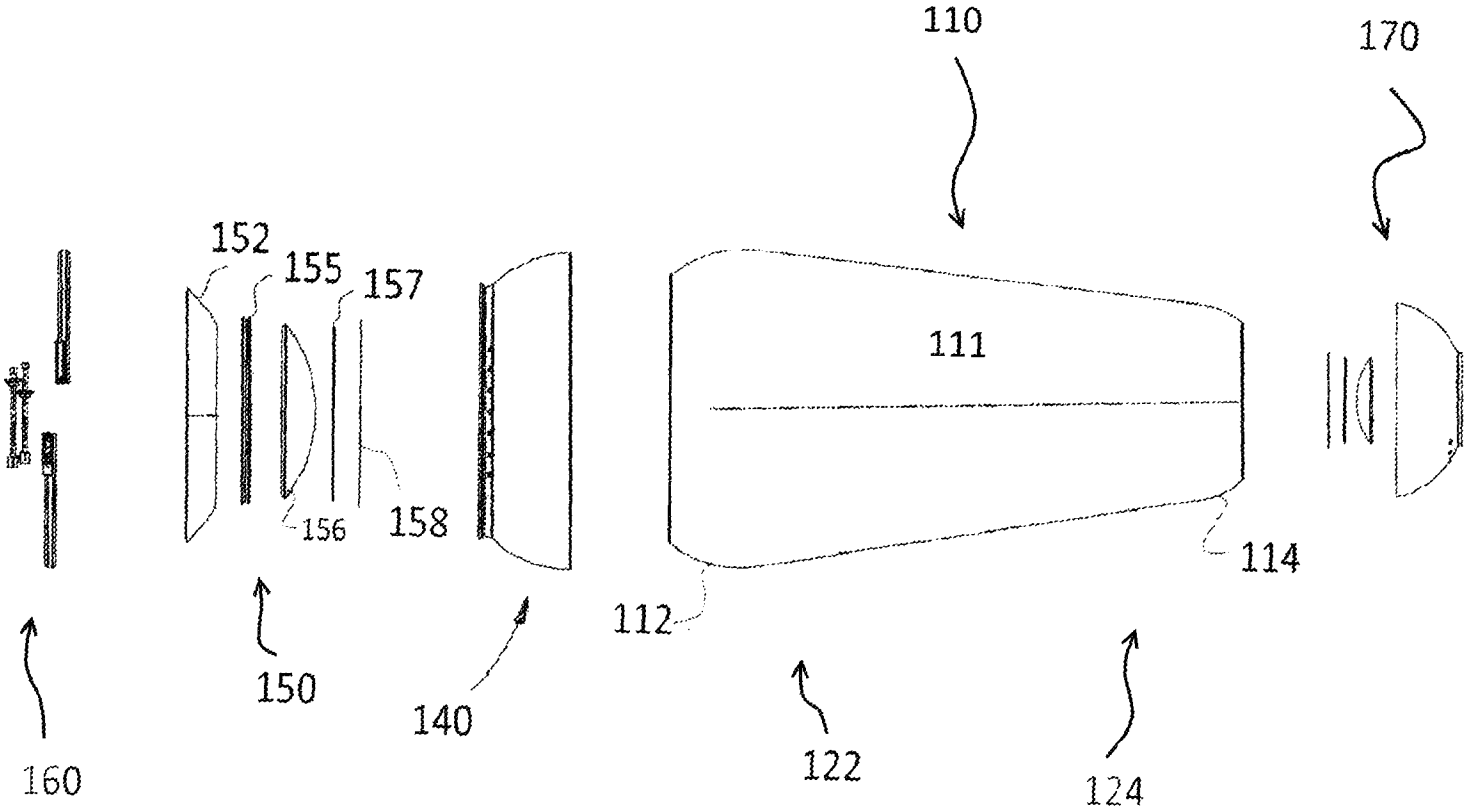
FIG. 3 is an exploded side view of the chamber of FIG. 1.

Referring to FIGS. 2 and 3, in the present embodiment, the chamber 100 comprises an open-ended tubular body 110, a first end member 140 and a second end member 170.

As it will be explained below, the first end member 140 and the second end member 170 are configured to be respectively mounted inside the tubular body 110 at the first extremity 112 and at the second extremity 114 thereof. The end members 140 and 170 are further configured such that, when the chamber 100 is supplied with gases and thus pressurized, the end members 140 and 170 are respectively urged against the inner surfaces of the first and second extremities 112 and 114 of the tubular body 110, thereby sealing the chamber 100.

Figure 4:
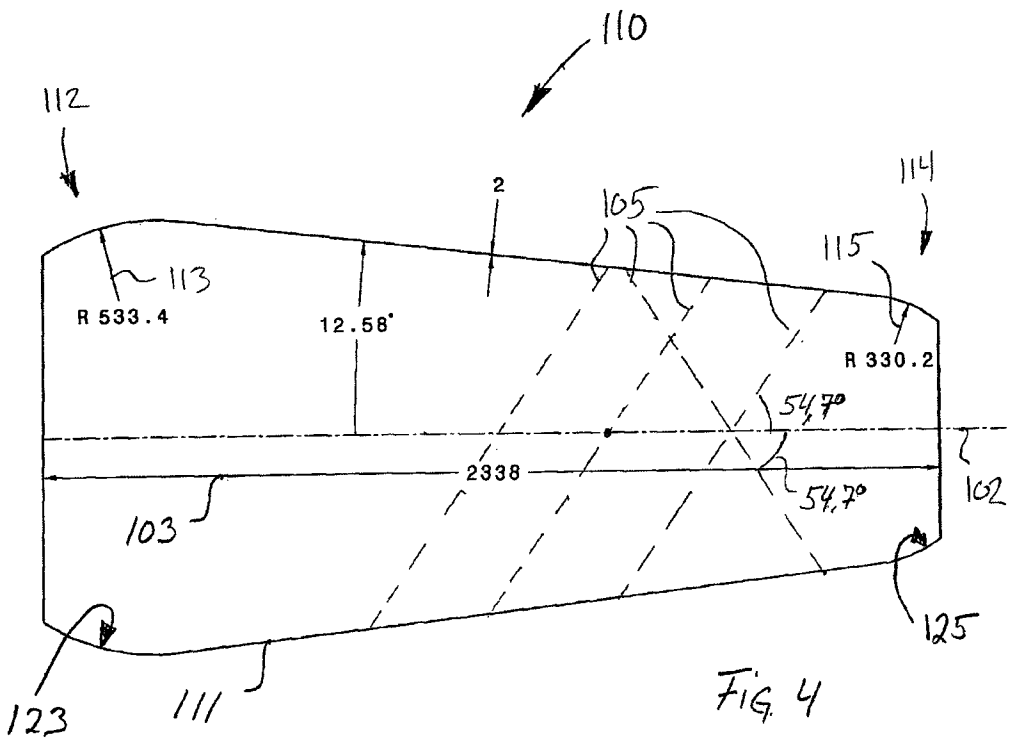
FIG. 4 is a cross-sectional side view of the tubular body of the chamber of FIG. 1.

Referring now to each composing elements of the chamber 100, and starting with the tubular body 110, as best illustrated in FIGS. 2-4, the tubular body 110 is typically of frustro-conical configuration. In that sense, the first or proximal extremity 112 has a generally larger diameter than the second or distal extremity 114. As the skilled addressee will understand, the first extremity 112, and its adjacent region 122, typically accommodate the upper portion (e.g. head and torso) of the body of the user while the second extremity 114, and its adjacent region 124, typically accommodate the lower portion (e.g. legs and feet) of the body of the user.

Figure 5:
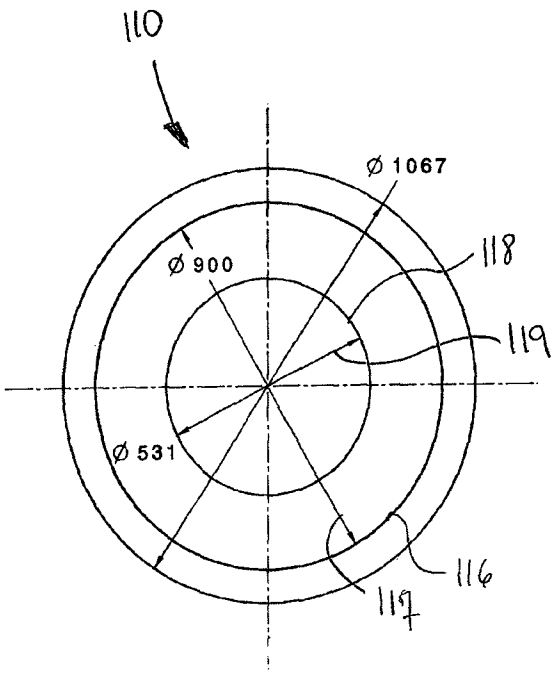
FIG. 5 is a front view of the tubular body of the chamber of FIG. 1.

As best shown in FIG. 5, the tubular body 110 typically has a circular cross-section. A circular cross-section is preferable to have a better distribution of pressure inside the tubular body 110.

The tubular body 110 is made of a flexible and airtight reinforced elastomeric material. In the present embodiment, the elastomeric material is a latex-neoprene composition which is reinforced with aramid filaments 105 wound about the tubular body 110.

As best shown in FIG. 4, the reinforcing filaments 105, only some of which are shown in phantom lines for clarity, are wound about the tubular body 110 at angle of approximately 54.7° (or −54.7°) with respect to the central axis 102. Though these angles are preferred, other angles are possible.

As the skilled addressee will understand, the winding of the filaments 105 extends along the whole length 103 of the tubular body 110.

Referring now to FIG. 2 and more particularly to FIGS. 3 and 4, the first extremity 112 and the second extremity 114 of the tubular body 110 are substantially of spherical configuration and they each comprise an opening.

The first extremity 112 therefore has a first radius of curvature 113 and a first opening 116 having a first diameter 117 while the second extremity 114 has a second radius of curvature 115, smaller than the first radius 113, and a second opening 118 having a second diameter 119.

In the present embodiment, the first and second diameters 117 and 119 are such that the reinforcing filaments 105 can be wound until the edges of the first and second openings.

Considering that the chamber 100 will be used for hyperbaric purposes, the material of the tubular body 110 is designed to be able to sustain positive relative pressures, typically up to 180 psig, without bursting. Under positive relative pressures, the chamber 100 will typically structurally maintain its shape.

Figure 10:
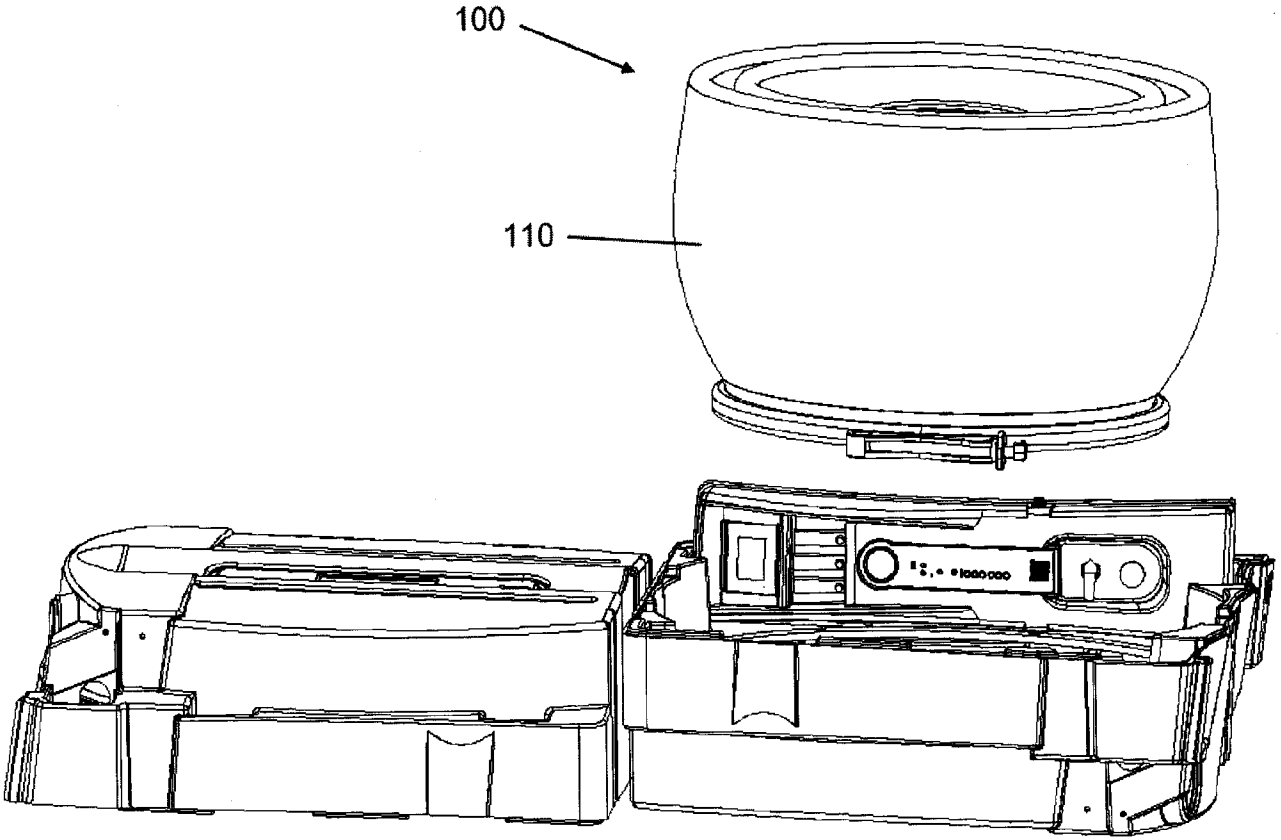
FIG. 10 is a perspective view of the chamber of FIG. 1, in collapsed configuration.
Figure 14:
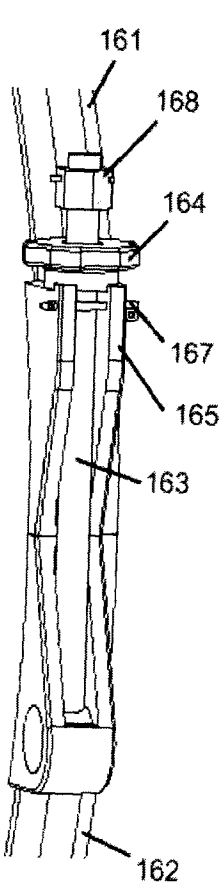
FIG. 14 is a fourth perspective fragmentary view of a portion of the locking ring assembly of the chamber of FIG. 1, during the locking procedure.

Still, despite being made of reinforced elastomeric material, the tubular body 110 is flexible enough such that it can be collapsed as shown in FIG. 10. In such a collapsed condition, the wall 111 of the tubular body 110 is rolled or folded until the second end member 170 is nested in the first end member 140. In such a compact collapsed condition, the chamber 100 can be more easily transported and/or stored. In that regard, having a tubular body 110 of frustro-conical shape is particularly advantageous since it allows the larger extremity 112, and its adjacent region 122, to easily receive the smaller extremity 114 and its adjacent region 124.

Referring now to FIGS. 2-3 and 6-7, the first end member 140 is shown in more details. The first end member 140 is typically larger than the second end member 170 and is configured to be mounted for cooperation with the first extremity 112 of the tubular body 110.

In the present embodiment, the end member 140 comprises an outer shell made of a fiberglass/epoxy composition, the shell having a polymeric foam core. The materials from which the end member 140 is made are preferably light such as to keep the overall weight of the chamber 100 low.

The first end member 140 comprises a first portion 142 which is located substantially inside the tubular body 110 during use, and a second portion 144 which extends outside of the tubular body 110 during use.

The first portion 142 defines a first exterior surface 146 which is substantially spherical in configuration. In that sense, the first exterior surface 146 generally has a radius of curvature 147 which is substantially equal to the radius of curvature 113 of the first extremity 112 of the tubular body 110. It is to be understood that the first exterior surface 146 is configured to engage the interior surface 123 of the first extremity 112 of the tubular body 110. It is thus important that the exterior shape of the first portion 142 of the first end member 140 generally matches the interior shape of the first extremity 112 of the tubular body 110 to prevent leaks when the chamber 100 is supplied with gases.

It is to be understood that in accordance with the principles of the present invention, there is no additional seal assembly between the first end member 140 and the first extremity 112 of the tubular body 110. In the end, the chamber 100 is ultimately sealed by the interaction between the first exterior surface 146 of the first end member 140 and the interior surface 123 of the first extremity 112 as the first end member 140 is urged axially under pressure.

The second portion 144, which extends from the first portion 142, comprises a radially extending lip or rim 148. The rim 148 is configured to cooperate with a locking ring assembly 160 to hold and lock the door assembly 150 in place.

Referring to FIGS. 2 to 4, the door assembly 150 comprises a main annular member 152 having an outer edge 151, a central opening 153, and an inner edge 154.

Referring more particularly to FIG. 7, a first ring 155 is secured (e.g. glued) to the inner edge 154 of the main member 152. Further mounted to the first ring 155 is a window 156 which is secured thereto by a second ring 158 fastened (e.g. bolted, screwed) to the first ring 155. A ring seal 157 is further located between the second ring 158 and the edge of the window 156 to prevent leaks.

As best shown in FIG. 7, in the present embodiment, the window 156 is shaped as an inward dome (i.e. a dome extending toward the interior of the chamber 100). Similarly, the shape of the main member 152 is substantially arcuate. Hence, the overall configuration of the main member 152 and of the window 156, i.e. of the door assembly 150, is inwardly domed. This allows the door assembly 150 to sustain higher pressure without breaking.

Though not shown, the door assembly 150 could be advantageously provided with one or more handles to ease its manipulation.

As already introduced above, the door assembly 150 is configured to be secured to the second portion 144 of the first end member 140 with the aid of the locking ring assembly 160. In that sense, as best shown in FIG. 7, the door assembly 150 and the second portion 144 are configured such that the outer edge 151 of the main member 152 rests adjacent to the radial rim 148.

Referring now to FIGS. 2, 3 and 7, in the present embodiment, the locking ring assembly 160 comprises a first half ring 161 and a second half ring 162. Both the first and the second half rings 161 and 162 have U-shaped cross-sections as best illustrated in FIG. 7. These U-shaped cross-sections serve to receive the radial rim 148 and the outer edge 151 of the main member 152 in a clamping arrangement.

Figure 6:
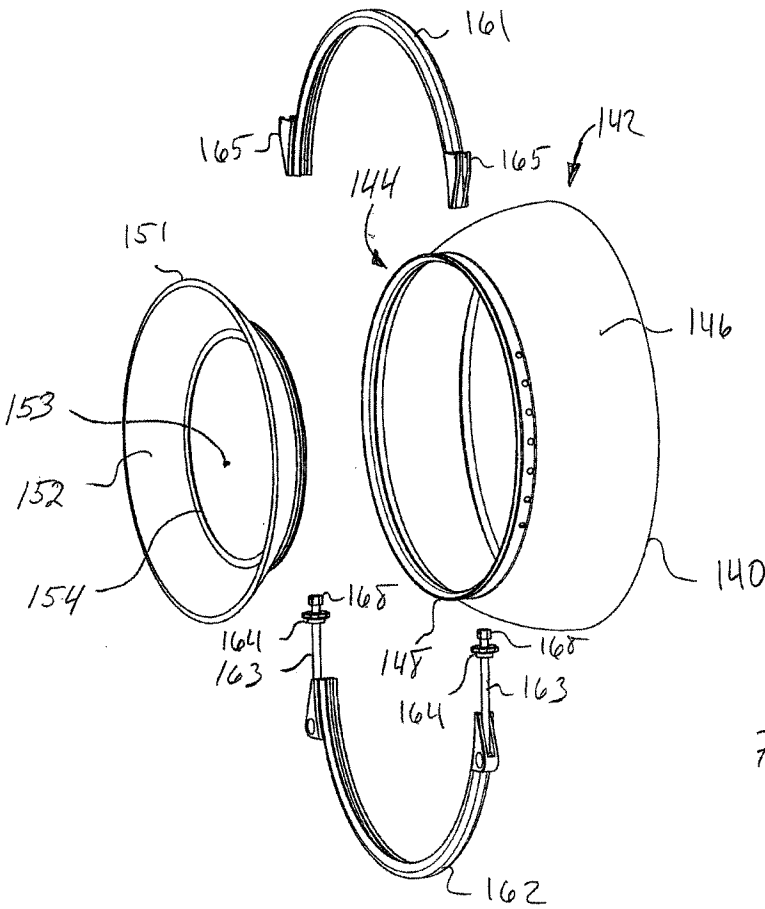
FIG. 6 is an exploded perspective view of the first end member of the chamber of FIG. 1.
Figure 4:
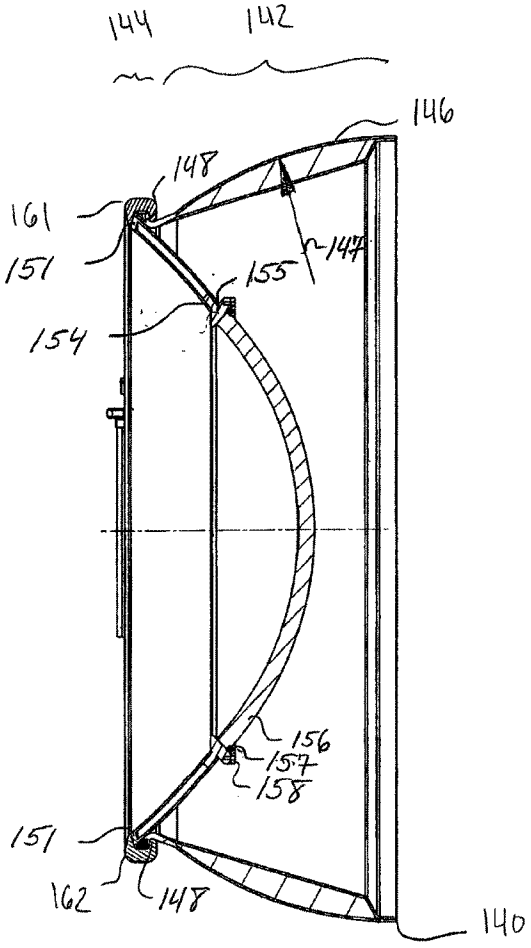
Figure 8:
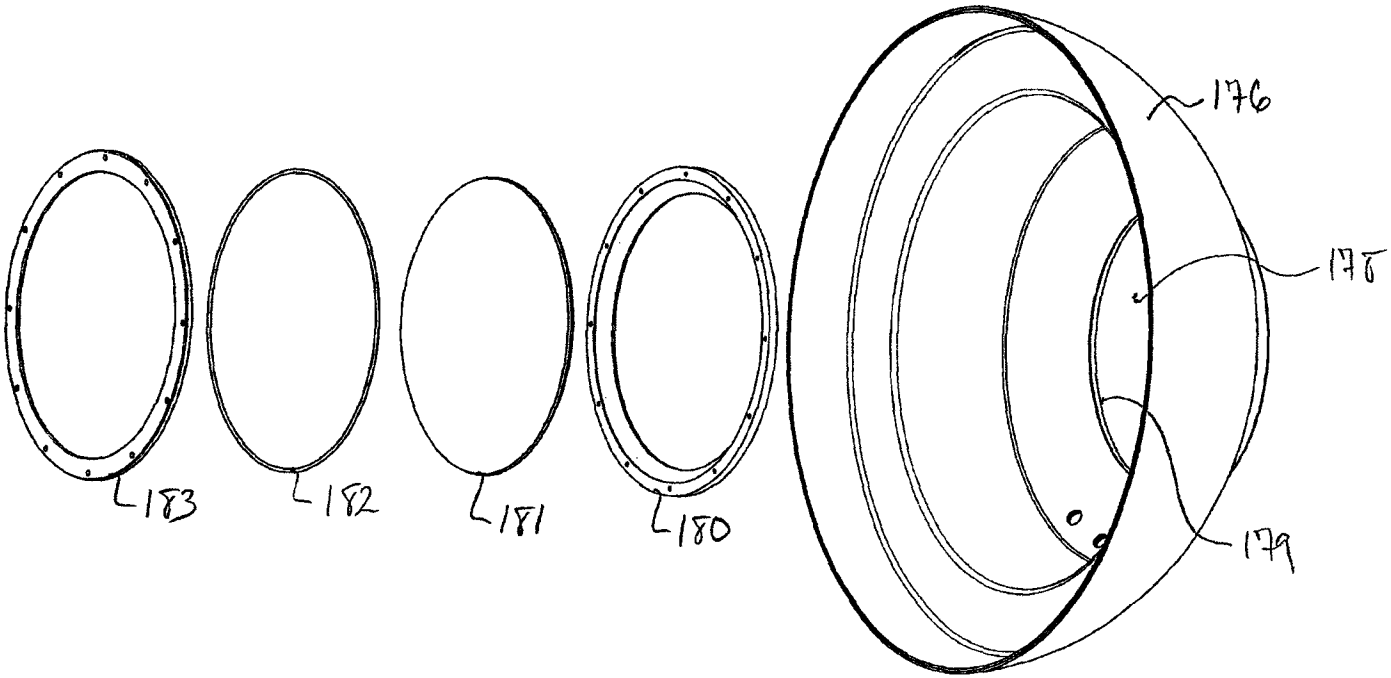
FIG. 8 is an exploded perspective view of the second end member of the chamber of FIG. 1.

Referring to FIGS. 2 and 6, two threaded rods 163 are pivotally mounted to half ring 162. Mounted to each of the threaded rods 163 is a threaded knob 164.

Referring to FIGS. 2, 6 and 11-14, to receive the rods 163 and the knobs 164, half ring 161 comprises two recessed portions 165, each having a flat top surface 166 and a transverse locking pin 167.

Figure 13:
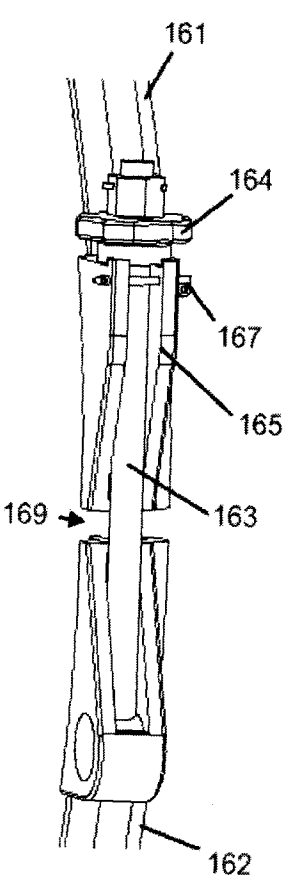
FIG. 13 is a third perspective fragmentary view of a portion of the locking ring assembly of the chamber of FIG. 1, during the locking procedure.
Figure 12:
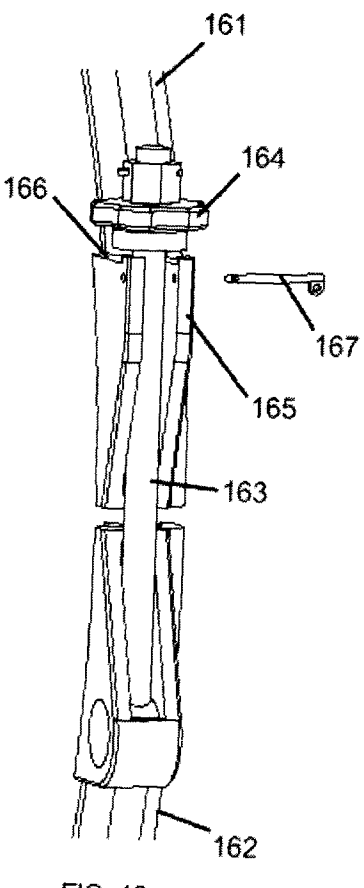
FIG. 12 is a second perspective fragmentary view of a portion of the locking ring assembly of the chamber of FIG. 1, during the locking procedure.
Figure 11:
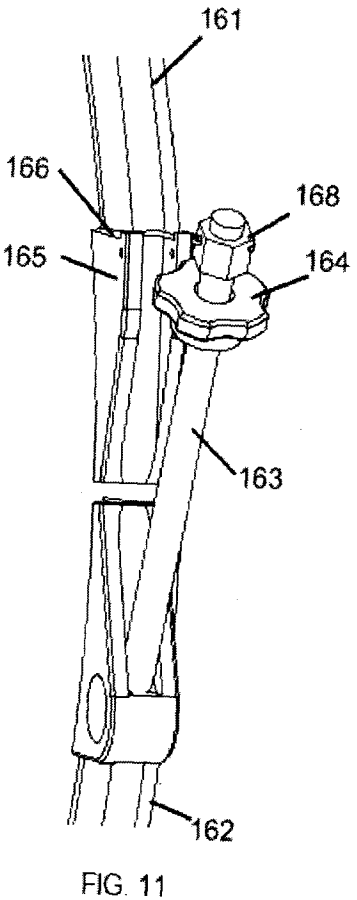
FIG. 11 is a first perspective fragmentary view of a portion of the locking ring assembly of the chamber of FIG. 1, during the locking procedure.

Referring now more particularly to FIGS. 11 to 14, in use, once the door assembly 150 is properly mounted to the first end member 140, i.e. the outer edge 151 being located adjacent to the radial rim 148, the first and second half rings 161 and 162 are mounted to the radial rim 148 and to the outer edge 151 of the main member 152 such as to fully circumscribe them. Then, to lock both half rings 161 and 162 together, the rods 163 are pivoted such as to come resting in the recessed portions 165 of half ring 161. Then, to prevent accidental exit of the rods 163 from the recessed portions 165, locking pins 167 are inserted transversally in the recessed portions 165 as shown in FIG. 12. Then, as shown in FIG. 13, the knobs 164 of both rods 163 are threaded down until abutment with the top surfaces 166 of the recessed portions 165. Finally, the knobs 164 of both rods 163 are further threaded down until the gap 169 between both half rings 161 and 162 is closed, thereby clamping both half rings 161 and 162 together and effectively locking the door assembly 150.

The remove the door assembly 150 from the first end member 140, the above procedure is substantially done in a reverse order.

In the present embodiment, each rod 163 is provided, at its free extremity, with a blocking element 168 such as, but not limited to, a safety screw with a transverse cotter pin, to prevent the knob 164 to be unscrewed beyond a predetermined point.

The skilled addressee will understand that the locking ring assembly 160 prevents accidental removal of the door assembly 150 even is one or both knobs 164 are accidentally unscrewed during a hyperbaric or a hypoxic treatment. Indeed, as long as the rods 163 are held and retained in their respective recessed portions 165 by the locking pins 167, both half rings 161 and 162 will remain attached together and will substantially circumscribe the door assembly 150.

The locking ring assembly 160 thus also adds a layer of safety to the operation of the chamber 100.

Referring now to FIGS. 2-3 and 8-9, the second end member 170 is shown in more details. As the skilled addressee will understand, the second end member 170 is typically smaller than the first end member 140 since it is configured to be mounted for cooperation with the second, and smaller, extremity 114 of the tubular body 110.

In the present embodiment, the second end member 170 comprises an outer shell made of a fiberglass/epoxy composition, the shell having a polymeric foam core. The materials from which the second end member 170 is made are preferably light such as to keep the overall weight of the chamber 100 low.

Typically, the second end member 170 is made of the same materials as the first end member 140.

The second end member 170 comprises a first portion 172 which is located substantially inside the tubular body 110 during use, and a second portion 174 which extends outside of the tubular body 110 during use.

The first portion 172 defines a second exterior surface 176 which is substantially spherical in configuration. In that sense, the second exterior surface 176 generally has a radius of curvature 177 which is substantially equal to the radius of curvature 115 of the second extremity 114 of the tubular body 110. It is to be understood that the second exterior surface 176 is configured to engage the interior surface 125 of the second extremity 114 of the tubular body 110. It is thus important that the exterior shape of the first portion 172 of the second end member 170 generally matches the interior shape of the second extremity 114 of the tubular body 110 to prevent leaks when the chamber 100 is supplied with gases.

Again, it is to be understood that in accordance with the principles of the present invention, as for the first end member 140, there is no additional seal assembly between the second end member 170 and the second extremity 114 of the tubular body 110. In the end, the chamber 100 is ultimately sealed by the interaction between the second exterior surface 176 of the second end member 170 and the interior surface 125 of the second extremity 114 as the second end member 170 is urged axially under pressure.

The second portion 174, which extends from the first portion 172, comprises a central opening 178 having an inner edge 179.

Figure 9:
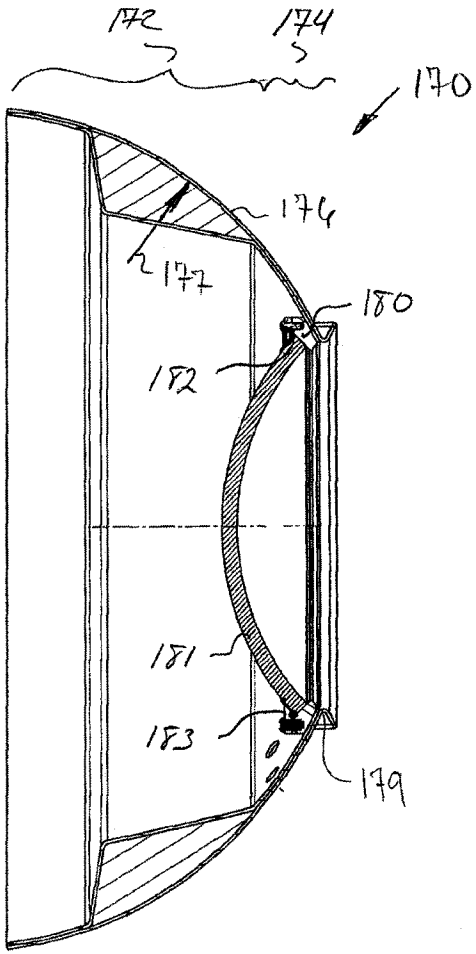
FIG. 9 is a cross cross-sectional side view of the second end member of the chamber of FIG. 1.

As shown in FIG. 9, a first ring 180 is secured (e.g. glued) to the inner edge 179 of the central opening 178. Mounted to the first ring 180 is a window 181 which is secured thereto by a second ring 183 fastened (e.g. bolted, screwed) to the first ring 180. A ring seal 182 is further located between the second ring 183 and the edge of the window 181 to prevent leaks.

As best shown in FIG. 9, in the present embodiment, the window 181 is shaped as an inward dome such as to allow the window 181 to sustain higher pressure without breaking.

In the normal assembled configuration of the chamber 100, the first portion 142 of the first end member 140 is mounted inside the tubular body 110 for engagement with the first extremity 112, and the first portion 172 of the second end member 170 is mounted inside the tubular body 110 for engagement with the second extremity 114.

In used, as the chamber 100 is supplied with gases during hyperbaric or hypoxic treatments, the gases will respectively axially push or urge the first end member 140, with the door assembly 150 mounted thereto, against the inner surface 123 of the first extremity 112, and the second end member 170 against the inner surface 125 of the second extremity 114. The engagement of the end members 140 and 170 with the respectively extremities 112 and 114 effectively seals the chamber 100 without additional seal assembly.

Hence, a chamber 100 in accordance with the principles of the present invention has a simpler configuration, is sturdy enough to sustain significant pressure (e.g. up to 180 psig), and is easily collapsible for storage and transport.

Though not shown, it is contemplated that the chamber 100 be provided with a mattress to support the user lying in the chamber 100 for treatment. The mattress could comprise a hinged structure to allow the user to take a seated position within the chamber 100. In addition, the mattress (e.g., synthetic foam material or similar material that will not affect the oxygen level in the chamber 100) would preferably be shaped to as to be received in the bottom of the chamber 100.

Though not shown, it is further contemplated that the chamber 100 be provided with handrails in order to facilitate movements inside the chamber 100 and/or to receive a stretcher (not shown). The handrails would preferably extend between the first and second end members 140 and 170 and would preferably be telescopic to facilitate transportation.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A chamber suitable for use with a portable hyperbaric and/or hypoxic chamber system, the chamber being connectable to at least one source of gases for receiving a supply of gases during a treatment, the chamber comprising:

a) an open-ended tubular body sized to accommodate at least one occupant, the tubular body being made of a flexible and reinforced elastomeric material; the tubular body comprising:
   i) a first opening at a first extremity of the tubular body;
   ii) a first substantially spherical extremity section adjacent with the first opening and having a first radius of curvature;
   iii) a second opening at a second extremity of the tubular body;
   iv) a second substantially spherical extremity section adjacent with the second opening and having a second radius of curvature; and
   v) a longitudinal axis;

b) a first end member adapted to be inserted into the open-ended tubular body and configured to be mounted substantially inside the tubular body at the first substantially spherical extremity section of the tubular body to close off the first opening of the first extremity section of the tubular body, the first end member comprising a first substantially spherical periphery having an exterior surface and a third radius of curvature, the third radius of curvature of the first end member being equal to the first radius of curvature of the first substantially spherical extremity section when the chamber is under pressure, the first end member also comprising a door for providing access to an interior of the tubular body;

c) a second end member adapted to be inserted into the open-ended tubular body and configured to be mounted substantially inside the tubular body at the second substantially spherical extremity section of the tubular body to close off the second opening of the second extremity section of the tubular body, the second end member comprising a second substantially spherical periphery having an exterior surface and a fourth radius of curvature, the fourth radius of curvature of the second member being equal to the second radius of curvature of the second substantially spherical extremity section when the chamber is under pressure;

whereby, in use, when the chamber is supplied with gases during hyperbaric and/or hypoxic treatment, the first and second end members are moved under pressure along the longitudinal axis in opposite directions such as the exterior surfaces of the spherical peripheries of the first and second end members are respectively urged against the spherical extremity sections of the first and second extremities of the flexible tubular body thereby sealing the chamber.

2. A chamber as claimed in claim 1, wherein the tubular body has a frustro-conical configuration.

3. A chamber as claimed in claim 2, wherein the first radius of curvature is larger than the second radius of curvature.

4. A chamber as claimed in claim 1, wherein the elastomeric material is a latex-neoprene composition.

5. A chamber as claimed in claim 1, wherein the elastomeric material is reinforced with filaments wound about the tubular body.

6. A chamber as claimed in claim 5, wherein the filaments are made of aramid.

7. A chamber as claimed in claim 5, wherein the filaments are wound about the tubular body at an angle with respect to the central axis.

8. A chamber as claimed in claim 7, wherein the angle is approximately 54.7 degrees or approximately −54.7 degrees.

9. A chamber as claimed in claim 8, wherein the first end member comprises a first portion configured to be mounted substantially inside the tubular body and a second portion configured to extend substantially outside the tubular body.

10. A chamber as claimed in claim 9, wherein the second portion comprises an opening and a radially extending rim.

11. A chamber as claimed in claim 10, wherein the door comprises an outer edge and wherein the door is configured to be mounted to the second portion of the first end member such as to close the opening of the second portion and such that the outer edge is located adjacent the rim of the second portion.

12. A chamber as claimed in claim 1, wherein the chamber further comprises a locking assembly for securing the door to the first end member.

13. A chamber as claimed in claim 11, wherein the chamber further comprises a locking assembly for securing the outer edge of the door to the rim of the second portion of the first end member, thereby securing the door to the first end member.

14. A portable chamber suitable for hyperbaric and/or hypoxic treatment, the chamber being connectable to at least one source of gases for receiving a supply of gases during the treatment, the chamber comprising:

a) an open-ended frustro-conical tubular body sized to accommodate at least one occupant, the tubular body being made of a flexible and reinforced elastomeric material, the tubular body comprising:
   i) a first opening at a first extremity of the tubular body;
   ii) a first substantially spherical extremity section adjacent with the first opening and having a first radius of curvature;
   iii) a second opening at a second extremity of the tubular body;
   iv) a second substantially spherical extremity section adjacent with the second opening and having a second radius of curvature, the first radius of curvature being larger than the second radius of curvature; and
   v) a longitudinal axis:

b) a first end member adapted to be inserted into the open-ended tubular body and configured to be mounted substantially inside the tubular body at the first extremity section to close off the first opening of the first extremity section, the first end member comprising a first substantially spherical periphery having an exterior surface and a third radius of curvature, the third radius of curvature of the first end member being equal to the first radius of curvature of the first substantially spherical extremity section when the chamber is under pressure, the first end member also comprising a door for providing access to an interior of the tubular body;

c) a second end member adapted to be inserted into the open-ended tubular body and configured to be mounted substantially inside the tubular body at the second extremity section to close off the second opening of the second extremity section, the second end member comprising a second substantially spherical periphery having an exterior surface and a fourth radius of curvature, the fourth radius of curvature of the second end member being equal to the second radius of curvature of the second substantially spherical extremity section when the chamber is under pressure;

whereby, in use, when the chamber is supplied with gases during hyperbaric and/or hypoxic treatment, the first end member is moved under pressure along the longitudinal axis towards the first extremity such as the first end member is urged against the first extremity section of the flexible tubular body, the exterior surface of the first spherical periphery then engaging an inner surface of the first extremity, and the second end member is moved under pressure along the longitudinal axis towards the second extremity such as the second end member is urged against the second extremity section of the flexible tubular body, the exterior surface of the second spherical periphery then engaging an inner surface of the second extremity, thereby sealing the chamber.

15. A portable chamber as claimed in claim 14, wherein the door is secured to the first end member via a locking ring assembly.

16. A hyperbaric and/or hypoxic chamber system comprising:

a) at least one source of gases;

b) a chamber connectable to the at least one source of gases for receiving a supply of gases, the chamber comprising:

i) an open-ended tubular body sized to accommodate at least one user, the tubular body being made of a flexible and reinforced elastomeric material, the tubular body comprising a longitudinal axis, a first opening at a first extremity of the tubular body, a first substantially spherical extremity section adjacent with the first opening and having a first radius of curvature, and a second opening at a second extremity of the tubular body; a second substantially spherical extremity section adjacent with the second opening and having a second radius of curvature;

ii) a first end member adapted to be inserted into the open-ended tubular body and configured to be mounted substantially inside the tubular body at the first extremity section to close off the first opening of the first extremity section, the first end member comprising a first substantially spherical periphery having an exterior surface and a third radius of curvature, the third radius of curvature of the first end member being equal to the first radius of curvature of the first substantially spherical extremity section when the chamber is under pressure, the first end member also comprising a door for providing access to an interior of the chamber;

iii) a second end member adapted to be inserted into the open-ended tubular body and configured to be mounted substantially inside the tubular body at the second extremity section to close off the second opening of the second extremity section, the second end member comprising a second substantially spherical periphery having an exterior surface and a fourth radius of curvature, the fourth radius of curvature of the second end member being equal to the second radius of curvature of the second substantially spherical extremity section when the chamber is under pressure;

whereby, in use, when the chamber received the supply of gases during hyperbaric and/or hypoxic treatment, the first end member is moved under pressure along the longitudinal axis towards the first extremity such as the first end member is urged against the first extremity section of the flexible tubular body, the exterior surface of the first spherical periphery then engaging an inner surface of the first extremity section, and the second end member is moved under pressure along the longitudinal axis towards the second extremity such as the second end member is urged against the second extremity section of the flexible tubular body, the exterior surface of the second spherical periphery then engaging an inner surface of the second extremity section, thereby sealing the chamber during the treatment.

17. A chamber system as claimed in claim 16, wherein the tubular body has a frustro-conical configuration.

18. A chamber system as claimed in claim 16, further comprising a control system operatively connected to the at least one source of gases for controlling the supply of the gases to the chamber.

19. A chamber system as claimed in claim 16, further comprising a support structure for supporting the chamber.

20. A chamber system as claimed in claim 18, further comprising a support structure for supporting the chamber.

21. A chamber system as claimed in claim 19, wherein the at least one source of gases is incorporated into the support structure.

22. A chamber system as claimed in claim 20, wherein the at least one source of gases is incorporated into the support structure.

23. A method for subjecting a user to a hyperbaric treatment using a chamber as claimed in claim 1, the method comprising:

a) the user entering the chamber, b) closing the door;

c) supplying the chamber with gases such that a pressure inside the chamber is substantially higher than a pressure outside the chamber.

24. A method for subjecting a user to a hypoxic treatment using a chamber as claimed in claim 1, the method comprising:

a) the user entering the chamber;

b) closing the door;

c) supplying the chamber with gases such that an oxygen level inside the chamber is lower than an oxygen level outside the chamber.

* * * * *